United States Patent [19]

Dreher

[11] 4,080,890

[45] Mar. 28, 1978

[54] VARIABLE NIP MINIMUM WRAP CALENDER

[75] Inventor: George L. Dreher, Beloit, Wis.

[73] Assignee: Beloit Corporation, Beloit, Wis.

[21] Appl. No.: 731,434

[22] Filed: Oct. 12, 1976

[51] Int. Cl.[2] ..... B30B 3/04

[52] U.S. Cl. ..... 100/170; 68/22 B; 100/35; 100/162 R

[58] Field of Search ..... 100/155–176, 100/35; 425/224, 235, 363, 367, 335; 162/358, 360; 72/205; 68/22 B; 156/324, 555

[56] References Cited

U.S. PATENT DOCUMENTS

| | | | |
|---|---|---|---|
| 1,629,681 | 5/1927 | Cram | 100/162 R |
| 2,623,377 | 12/1952 | Dungler | 68/22 B |
| 2,678,465 | 5/1954 | Schnuck et al. | 100/170 X |
| 3,332,260 | 7/1967 | Bisang | 100/170 X |
| 3,720,160 | 3/1973 | Kraft et al. | 100/176 X |

FOREIGN PATENT DOCUMENTS

| | | | |
|---|---|---|---|
| 1,504,060 | 3/1969 | Germany | 100/168 |
| 596,594 | 1/1948 | United Kingdom | 162/358 |

*Primary Examiner*—Edward J. McCarthy
*Attorney, Agent, or Firm*—Hill, Gross, Simpson, Van Santen, Steadman, Chiara & Simpson

[57] ABSTRACT

A pair of calender rolls have the web to be calendered directed to wrap only about 90° in travelling on one of the rolls into the nip of the rolls and then to wrap only about 90° on the other of the rolls after leaving the nip. Pressure of the nip is variable. Additional variable nips may be provided by means of rolls located in nip relation to the first two rolls to engage the web about 90° from the nip of the first two rolls. Automatic sheet threading is provided for. Provision is made for applying liquid solution to the web in the calender.

15 Claims, 1 Drawing Figure

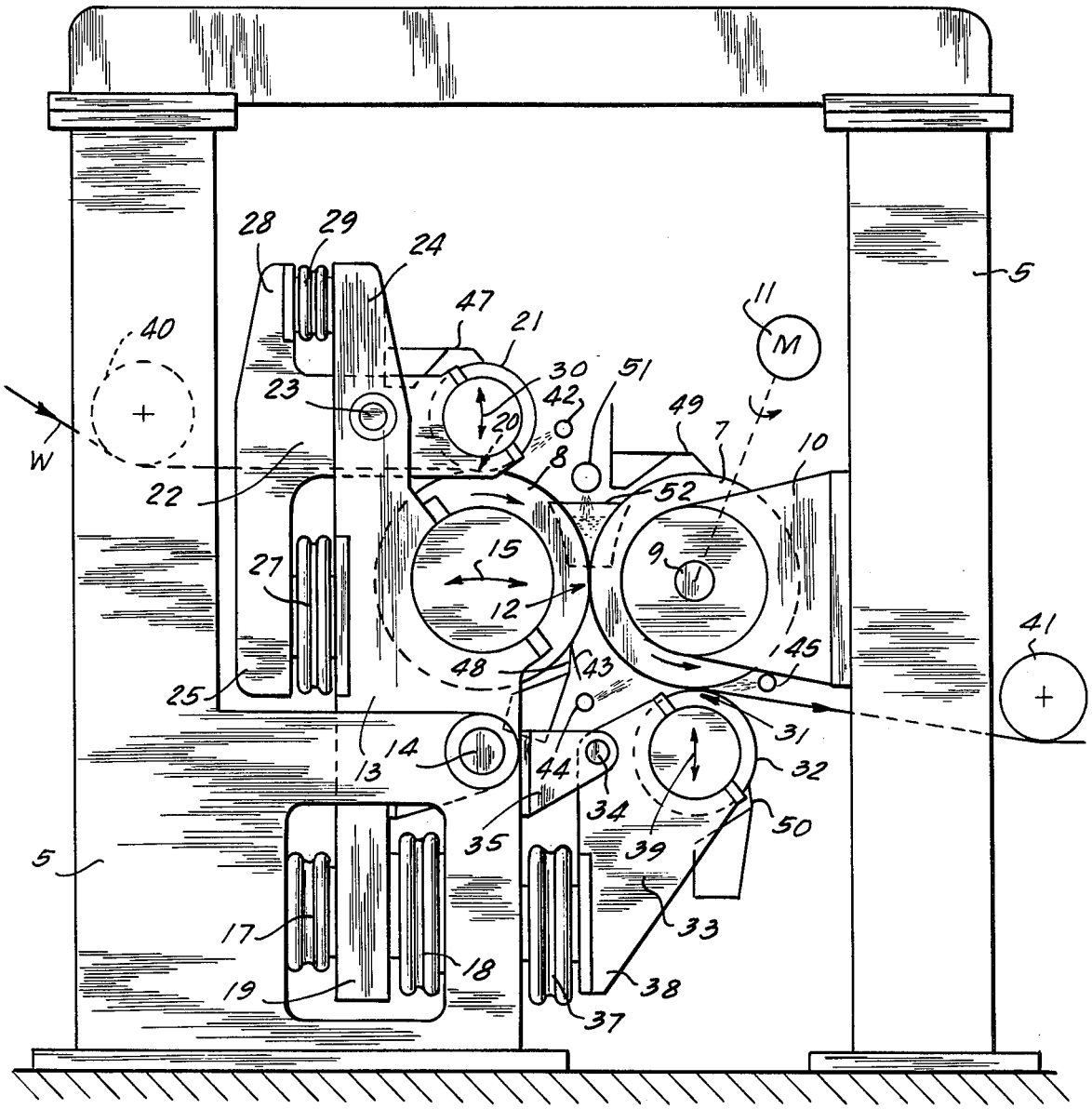
28
29
24
47
21
11
M
5
40
30
51
23
42
49
7
10
20
8
W
22
52
15
9
27
12
41
48
43
145
25
31
14
44
32
13
34
50
35
39
5
33
17
18
38
19
37

VARIABLE NIP MINIMUM WRAP CALENDER

This invention relates to the art of calendering in the paper industry and is particularly concerned with a new and improved calender and method especially adapted to handle both high and low density paper board sheet or web.

Conventional calenders have one or more vertical stacks of rolls on which the paper web is trained to travel over 180° of the perimeter of successive rolls. An example of such a calender stack is disclosed in U.S. Pat. No. 3,525,301. Such calenders have the disadvantage of excessive wrap on the rolls for the heavier weights of paper board webs leading to cracking or rupturing. With respect to lightweight sheets or webs there is a tendency to barring at high speeds. In addition, vertical stack calenders do not lend themselves readily to the accommodation of various densities of paper board webs.

Manual threading of calender rolls is a hazardous maneuver.

Application of a liquid solution such as sizing or color to the web is generally effected in a separate applicator.

An important object of the present invention is to overcome the disadvantages, deficiencies, inefficiencies, shortcomings and problems encountered in and in respect to prior calenders, and to provide a new and improved variable nip minimum wrap calender and a method especially suitable for calendering both high and low density paper board webs.

Another object of the invention is to provide a new and improved variable nip minimum wrap calender in which minimum wrap on the calender rolls advantageously maintains integrity and stiffness in calendering heavy weight board webs such as that commonly referred to as cylinder board, as well as advantageously reduces or eliminates barring at high speeds when running lightweight webs.

A further object of the invention is to provide a new and improved variable nip minimum wrap calender which will provide complete individual loading control of each calender nip irrespect of the other nips.

Still another object of the invention is to provide a variable nip minimum wrap calender especially suitable to run high bulk paper webs with a maximum finish.

Yet another object of the invention is to provide new and improved calender adapted to run with one, two or three nips.

A yet further object of the invention is to provide new and improved automatic web threading in a calender and thereby eliminate the nip hazards to the machine tender.

A still further object of the invention is to provide convenient and inexpensive means in a calender for applying a liquid solution to the web.

According to features of the invention, a variable nip minimum wrap calender comprises a supporting structure, a pair of calender rolls carried rotatably by the supporting structure and providing a calendering nip, means for relatively adjusting the rolls to control the nip pressure, means for driving at least one of the rolls rotatably, and means for limiting wrap of a travelling web to be calendered in the nip to surface segments of about 90° on the rolls measured from the nip. Additional selective nips may be provided by means of respective nip rolls acting with each roll of the pair at about 90° from the nip between the pair of rolls. Means may be provided above the nip of the pair of rolls for applying a liquid solution to the web. Automatic sheet threading means are provided.

According to additional features of the invention there is provided a method of variable nip minimum wrap calendering comprising supporting a pair of calender rolls rotatably in calendering nip relation, relatively adjusting the rolls and thereby controlling the nip pressure, driving at least one of the rolls rotatably, and limiting wrap of travelling web to be calendered in the calendering nip to surface segments of about 90° on the rolls measured from the nip.

The web may be calendered in additional nips on the respective rolls of the pair at about 90° from the nip of the pair of rolls. A liquid treating solution may be applied to the web in the area above the nip of the pair of rolls. Automatic air control threading of the web through the calender rolls is provided for.

Other objects, features and advantages of the invention will be readily apparent from the following description of a representative embodiment thereof, taken in conjunction with the accompanying drawing although variations and modifications may be effected without departing from the spirit and scope of the novel concepts embodied in the disclosure, and in which:

The drawing illustrates a variable nip minimum wrap calender according to the present invention, with certain features represented schematically.

On reference to the drawing, a supporting structure 5 in the form of a suitable machine frame rotatably carries a pair of calender rolls which are desirably of substantial diameter and comprise a roll 7 and a companion roll 8 in side-by-side parallel relation and with their axes desirably in a common substantially horizontal plane. One of the pair of rolls, herein the roll 7, has its shaft 9 carried by fixed bracket means 10 on the frame 5 and adapted to be driven to rotate the roll 7 at a desired speed by power means such as a motor 11.

Although the calender roll 8 may be rotatably driven, it is shown as being in idling slave relation to the roll 7 through their nip 12. Rotary support for the roll 8 is provided on the frame 5 by means which will permit relatively adjusting the rolls to control the nip pressure, herein comprising a carriage 13 pivotally mounted by pivot means 14 on the frame 5 on an axis preferably located substantially vertically below the roll 8 whereby the roll 8 can be moved toward and away from the roll 7 as indicated by directional arrow 15 through rocking of the carriage 13 on the pivot 14. Such rocking movements of the carriage 13 are adapted to be effected by means of suitable actuating and biasing means comprising air springs 17 and 18 acting on opposite sides of a downwardly projecting arm 19 of the carriage 13. Because the actuator air spring 18 is oriented to rock the carriage 13 in the nip pressure direction of the roll 8 toward the roll 7, it is desirably larger and of larger power capacity than the actuator air spring 17 and operable to rock the carriage for shifting the roll 8 away from the roll 7. By operation of the acutator air springs 17 and 18, the roll 8 can be moved toward and away from the roll 7 throughout a substantial range. Further, the nip pressure can be readily adjusted to any reasonable value to attain the desired calendering results. The pressure at the nip 12 may go as high as 1000 pounds per linear inch if desired, although such high nip loads on paper board webs are not common or especially desirable due to the potential problem of crushing the board. However for other types of stock it may be desirable to go that high. In any event, the construction as described provides the potential for the extremely high nip pressure and enables the optimum pressure for the particular web being run at any given time to be optimumly adjusted to attain the most desirable stiffness and mullen, i.e., bursting strength, values for the web being run.

An additional calendering nip 20 may be provided on the roll 8 by means of a calender roll 21 advantageously located to provide the nip 20 about 90° from the nip 12. In order to get a sharper, i.e., narrower, nip line on the web being calendered, the roll 21 is advantageously of a smaller diameter than the roll 8. Thereby high unit pressures can be attained up to 1000 pli, for example, with economical power expenditure.

For not only adjusting the nip pressure of the roll 21, but also to enable selective use of the nip 20, the roll 21 is mounted by means which will enable movement of the roll 21 toward and away from the roll 8, such means advantageously comprising a carriage 22 mounted on a pivotal axis rocker axle 23 on an upstanding arm 24 on the carriage 13. One end of the carriage 22 extends beyond one side of the arm 24 into overlying relation to the roll 8 and rotatably supports the roll 21. The opposite end of the arm 22 extends toward the opposite side of the arm 24 and has a depending arm 25 between which and the carriage 13 an actuator air spring 27 is operatively mounted for driving the carriage 22 clockwise as seen in the drawing to thrust the roll 21 into nip relation to the roll 8. An upstanding arm 28 on the carriage 22 mounts an actuator air spring 29 with the arm 24 and is operable to actuate the carriage 22 in counterclockwise direction whereby to lift the roll 21 from the roll 8. Shifting movement potential for the roll 21 is indicated by the double ended directional arrow 30.

A third calendering nip 31 is provided for by means of a calender roll 32 located in nip relation to the underside of the roll 7 about 90° from the nip 12. Rotary support for the roll 32 is provided by means of a carriage 33 which is advantageously pivotally mounted adjacent its upper end by means of a pivot axle 34 carried by a fixed bracket 35 on the frame 5. This arrangement permits gravity bias to swing the roll 32 away from the roll 7, when that condition is desired. To thrust the roll 32 into nip relation to the roll 7, means comprising an actuator air spring 37 is mounted operatively between a depending arm 38 on the carriage 33 and the adjacent part of the frame 5. The roll 32, similarly as the roll 21, is advantageously of substantially smaller diameter than the roll 7 whereby to attain the advantage of a sharp nip line on the web with an economical power expenditure. Movement capability of the roll 32 relative to the roll 7 either to move the roll 32 into non-operating position, or into calendering nip position is indicated by the double ended directional arrow 39.

By their relationship to the rolls 7 and 8, the calender rolls 21 and 32 may serve as primary guides for a web W to be calendered to control wrap of the web to the about 90° segments of the rolls 7 and 8 measured from the nip 12. A guide roll 40 may assist in this function in respect to the on-running web as it approaches the calender rolls, and a guide roll 41 may assist in this function for the off-running web after it leaves the calender rolls.

In order to eliminate the nip hazards for the machine tender in threading the web W through the calender rolls, automatic threading means are provided, in a desirable form comprising an air shower member 42 which drives air toward the roll 8 at the off-running side of the nip 20 to push the leading end of the web onto the surface of the roll 8 and thereby direct the leading end of the web to the nip 12. On leaving the nip 12, the leading end of the web is deflected generally toward the roll 7 by a deflector 43 and then blown toward the roll 7 by an air shower from a device 44 so as to enter the nip 31. On leaving the nip 31 means comprising an air shower device 45 causes the leading end of the web to move downwardly away from the roll 7 to a position where it can be grasped by hand and passed to the reel ropes either by hand for slow speed operation or by air chute for high speed operation. If preferred, the air shower devices 42, 44 and 45 may be replaced by suitably oriented doctor blades.

A roll cleaning doctor 47 may be mounted on the carriage 22 for cleaning the roll 21. A similar doctor 48 may be mounted on the carriage 13 for cleaning the roll 8. A doctor 49 may be suitably mounted on the frame 5 for cleaning the roll 7, and a doctor 50 may be mounted on the carriage 33 for cleaning the roll 32.

Any or all of the calender rolls may be controlled crown rolls, that is provided with means to counteract and control any tendency toward convexity of the rolls at the nip line due to deflection of the roll surface which may result from nip loading as well as gravity, depending upon the size of the rolls. Various means for crown control are represented in issued patents, representative examples of which are found in U.S. Pat. Nos. 3,119,324 and 3,276,102. Where heated oil is used inside the controlled crown roll, the heated roll surface aids in producing a smooth surface on the calendered web, especially at lower nip pressures employed for the heavier grades of board web.

The capability and ease of utilizing one, two or three nips provided by the arrangement of the calender according to the present invention facilitates calendering any desired density of board web. In the paper industry, the density of the sheet web being produced is usually expressed in terms of pounds per caliper point. A caliper point is one thousandth (0.001) inch and the traditional area of the sheet being measured is 3000 $ft^2$, expressing density in terms of linear measurements and commonly understood in connection with the width of the sheet being produced on a paper making machine. So called "high density" board is about 13 pounds/caliper point, "medium density" board is about 11 pounds/caliper point, and "low density" board is about 9.5 pounds/caliper point. Paper board web may range from about 6 points to about 30 points, and high density board may weigh from about 80 pounds per 3000 square feet to about 380 pounds per 3000 square feet. The calender apparatus of the present invention is especially adapted for calendering low density board due to the capability of individually adjusting the nip pressure at each of the nips or to utilize as little as a single nip. Since wrap on the large horizontally oriented rolls 7 and 8 may be no more than about 90° measured from their nip 12 substantial elimination of any tendency to break the outer surface fibers or crack or develop fold marks or barring is attained.

Another advantage of having the nip 12 between the horizontally oriented rolls 7 and 8 directed upwardly resides in that it provides a convenient trough for applying a liquid solution treatment such as sizing or color to the web W. For this purpose treating solution may be supplied in a controlled manner through means such as a manifold 51 into the nip trough. At its opposite ends, the nip trough is suitably closed by means of appropriate dams 52.

It will be understood that variations and modifications may be effected without departing from the spirit and scope of the novel concepts of this invention.

I claim as my invention:

1. A variable nip minimum wrap calender, comprising:

a supporting structure;

a pair of calender rolls comprising a first roll and a second roll carried rotatably by said supporting structure and providing a calendering nip means for relatively adjusting the pair of rolls to control the nip pressure;

means for driving at least one of said pair of rolls rotatably;

means for limiting wrap of a travelling web to be calendered in said nip to respective surface segments of about 90° on said rolls measured from said nip;

said means for relatively adjusting the rolls comprising a movable carriage mounted on said supporting structure and carrying said first roll, and means for actuating said carriage;

a carriage mounted to pivot on said first roll carriage and carrying another roll in nipping relation to said first roll;

and means for pivotally actuating said another roll carriage on and relative to said first roll carriage for effecting nipping adjustments of said another roll relative to said first roll.

2. A calender according to claim 1, wherein said pair of rolls are located with their axes in a substantially horizontal plane, said first roll carriage comprising a substantially vertically extending member, pivot means mounting said member on said supporting structure on a substantially horizontal axis below said first roll, said member having a downwardly projecting arm, actuator air spring means mounted on and between said downwardly projecting arm and said supporting structure whereby to enable rocking of said member about said pivot means to effect relative nipping adjustments of the first roll relative to the second roll, said member having an upstanding arm projecting substantially above said first roll, said another roll carriage comprising a generally horizontally extending portion, means pivotally connecting said portion to said upstanding arm at an elevation above said first roll and with one part of said portion extending substantially over said first roll, said another roll pivotally carried by said one part, said portion having another part extending in the opposite direction from said upstanding arm and having upwardly and downwardly extending arm portions spaced from said upstanding arm and said carriage member, and actuator air spring means mounted on and between said upwardly extending arm portion and said upstanding arm and between said downwardly projecting arm portion and said carriage member and comprising said means for pivotally actuating said another roll carriage.

3. A calender according to claim 1, including an additional calender roll in nip relation to the second of said pair of calender rolls about 90° from said calendering nip of the pair of rolls.

4. A calender according to claim 3, said another and additional calender rolls being in nip relation to each of said pair of calender rolls at about 90° measured from said nips of the pair of rolls and adapted to serve as the means for limiting wrap of the travelling web.

5. A calender according to claim 4, comprising a carriage rotatably mounting said additional calender roll, means pivotally mounting said another calender carriage on said supporting structure, and actuator air spring means mounted on and between said additional calender roll carriage and said supporting structure for effecting rocking of said additional calender roll carriage relative to said supporting structure for adjusting nip pressure of said additional calender roll relative to said second calender roll.

6. A calender according to claim 4, wherein said another and additional rolls are of substantially smaller diameter than said pair of rolls whereby to attain a sharp nip line with the larger pair of rolls.

7. A calender according to claim 1, including means for automatically threading the web through the nip.

8. A calender according to claim 1, wherein said pair of rolls are on axes in a substantially horizontal plane, the upper side of said nip of the pair of rolls defining a trough, and means for supplying a web treating solution to the trough.

9. A calender according to claim 2, comprising a carriage rotatably mounting said additional calender roll, means pivotally mounting said another calender carriage on said supporting structure, and actuator air spring means mounted on and between said additional calender roll carriage and said supporting structure for effecting rocking of said additional calender roll carriage relative to said supporting structure for adjusting nip pressure of said additional calender roll relative to said second calender roll.

10. A method of variable nip minimum wrap calendering, comprising:

supporting a pair of calender rolls comprising a first roll and a second roll rotatably in a calendering nip relation;

driving at least one of said rolls rotatably;

mounting said first roll on a carriage pivotally mounted on supporting structure;

actuating said carriage pivotally to adjust the nip of said first and second rolls;

mounting another roll on a carriage;

mounting said another roll carriage pivotally on said first roll carriage;

and pivotally actuating said another roll carriage on and relative to said first roll carriage and thereby effecting nipping adjustments of said another roll relative to said first roll.

11. A method according to claim 10, including operating an additional calender roll in nip relation to the second of said pair of calender rolls about 90° from said calendering nip of the pair of rolls.

12. A method according to claim 10, including operating said another and said additional calender rolls in nip relation to each of said pair of calender rolls at about 90° measured from said nip of the pair of rolls, and limiting wrap of the travelling web by means of said additional rolls.

13. A method according to claim 10, comprising mounting said pair of rolls on axes located in a substantially horizontal plane, pivotally mounting said first roll carriage on a horizontal axis below said first roll, providing said first roll carriage with upwardly and downwardly projecting arms, actuating said downwardly projecting arm to effect rocking movements of the first roll carriage and thereby adjusting the nipping relation of said first and second rolls, mounting said another roll carriage on the upwardly projecting arm of the first roll carriage, pivotally mounting said another roll carriage on said upstanding arm at an elevation above said first roll, and effecting rocking of said second roll carriage on said upstanding arm for adjusting nipping relation of said another roll relative to said first roll.

14. A method according to claim 10, comprising mounting an additional calender roll on a carriage, pivotally mounting the additional roll carriage in position relative to said second calender roll, and pivotally actuating said additional calender roll carriage and thereby effecting adjusted nipping relation of said additional calender roll with said second calender roll.

15. A method according to claim 13, comprising mounting an additional calender roll on a carriage, pivotally mounting the additional roll carriage in position relative to said second calender roll, and pivotally actuating said additional calender roll carriage and thereby effecting adjusted nipping relation of said additional calender roll with said second calender roll.

* * * * *

UNITED STATES PATENT AND TRADEMARK OFFICE

CERTIFICATE OF CORRECTION

PATENT NO. : 4,080,890

DATED : March 28, 1978

INVENTOR(S) : George L. Dreher

It is certified that error appears in the above-identified patent and that said Letters Patent are hereby corrected as shown below:

The following claims should be included in the Patent:

16. A method according to claim 12, wherein said another and said additional rolls are of substantially smaller diameter than said pair of rolls, and comprising effecting a sharp nip line of said another and additional rolls with the larger pair of rolls.

17. A method according to claim 10, including automatically threading the web through the nips.

18. A method according to claim 10, comprising supplying a web treating solution to a trough defined on the upper side of said nip of said pair of rolls.

On the cover sheet, "Claims 15" should read -- Claims 18 --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*